US011763645B2

(12) United States Patent
Hall et al.

(10) Patent No.: US 11,763,645 B2
(45) Date of Patent: Sep. 19, 2023

(54) LED LIGHT AND SOUND BALL FOR EMERGENCY RESPONDERS

(71) Applicants: Robert Hall, Franklin, TN (US); Nicchia Hall, Franklin, TN (US)

(72) Inventors: Robert Hall, Franklin, TN (US); Nicchia Hall, Franklin, TN (US)

( * ) Notice: Subject to any disclaimer, the term of this patent is extended or adjusted under 35 U.S.C. 154(b) by 0 days.

(21) Appl. No.: 17/725,506

(22) Filed: Apr. 20, 2022

(65) Prior Publication Data

US 2022/0246002 A1 Aug. 4, 2022

Related U.S. Application Data

(63) Continuation-in-part of application No. 17/527,124, filed on Nov. 15, 2021, now abandoned.

(60) Provisional application No. 63/113,812, filed on Nov. 13, 2020.

(51) Int. Cl.

| | |
|---|---|
| ***G08B 5/22*** | (2006.01) |
| ***A63B 43/06*** | (2006.01) |
| ***F21V 23/04*** | (2006.01) |
| ***F21L 4/02*** | (2006.01) |

(Continued)

(52) U.S. Cl.

CPC ..... *G08B 5/22* (2013.01); *A63B 43/06* (2013.01); *F21L 4/02* (2013.01); *F21V 23/04* (2013.01); *F21W 2131/40* (2013.01); *F21Y 2115/10* (2016.08)

(58) Field of Classification Search

CPC .... A63B 43/06; F21W 2131/40; F21V 23/04; G08B 5/36

See application file for complete search history.

(56) References Cited

U.S. PATENT DOCUMENTS

| | | | |
|---|---|---|---|
| 5,967,133 | A | 10/1999 | Gardner, Jr. |
| 6,712,487 | B2 | 3/2004 | Liou |
| 7,785,215 | B2 | 8/2010 | Kohnen, II |

(Continued)

FOREIGN PATENT DOCUMENTS

| | | | |
|---|---|---|---|
| CN | 201852008 | U | 6/2011 |
| JP | 200018891 | A | 1/2000 |
| JP | 2005224420 | A | 8/2005 |

OTHER PUBLICATIONS

"Distract-Ball", Durendal LLC,(2022), printed from www.durendal-llc.com on Apr. 19, 2022.

*Primary Examiner* — Karabi Guharay

(74) *Attorney, Agent, or Firm* — Nath, Goldberg & Meyer; Richard C. Litman

(57) ABSTRACT

The LED light and sound ball for emergency responders is activated upon contact after being fired from a launcher to illuminate and direct responders to an area of interest, such as a potential crime scene. The ball includes a clear polymeric, spherical outer casing, and a rectangular, clear inner casing having a circuit board mounted therein. A plurality of rig rods extend through the inner casing and include curved heads that are in close proximity to the inner surface of the spherical outer casing. Upon impact, the outer casing flexes and pushes against one of the curved heads and pushes its associated rig rod inward, thereby closing a contact that triggers a control circuit to continuously illuminate a plurality of bright LEDs and continuously activate a sound generator that emits a foghorn-type alarm. The LED light and sound ball may be thrown or fired from a conventional compressed air launcher.

18 Claims, 4 Drawing Sheets

(51) Int. Cl.
*F21W 131/40* (2006.01)
*F21Y 115/10* (2016.01)

(56) References Cited

U.S. PATENT DOCUMENTS

| | | | | |
|---|---|---|---|---|
| 8,992,353 | B1 | 3/2015 | Kortegast | |
| 10,184,760 | B2 | 1/2019 | Bishop et al. | |
| 2003/0202362 | A1* | 10/2003 | Liou | A63B 43/06 362/555 |
| 2004/0162170 | A1* | 8/2004 | Ng | A63B 43/00 473/571 |
| 2018/0181654 | A1* | 6/2018 | Young | A63B 43/06 |
| 2019/0195604 | A1 | 6/2019 | Rodgers, Jr. et al. | |

* cited by examiner

LED LIGHT AND SOUND BALL FOR EMERGENCY RESPONDERS

CROSS-REFERENCE TO RELATED APPLICATION

This application is a continuation-in-part of U.S. patent application Ser. No. 17/527,124, filed on Nov. 15, 2021 and amended by preliminary amendment filed on Jan. 31, 2022, and which claims the benefit of U.S. Provisional Patent Application No. 63/113,812, filed on Nov. 13, 2020.

BACKGROUND

1. Field

The disclosure of the present patent application relates to emergency response devices, and particularly to an LED light and sound ball for emergency responders.

2. Description of the Related Art

In general, emergency response devices are used by emergency responders to distract, disable, or tag potential criminal perpetrators (perps). Some of these devices are in the form of a projectile and include distraction balls that emit a single beam of light that spins with the ball and thereby distracts the subject. Other projectile devices used by emergency responders include a ball that hits the perp and releases a dye/odor pack to later identify the perp. Other light ball devices are activated by vibration and can therefore illuminate before reaching the area of the perp, thereby alerting them before illuminating them. Some previous devices include timers and can therefore turn themselves off prior to the situation being resolved. Further, these prior art devices lack sound and do not provide the "flash-bang" effect of the more dangerous explosive devices, often used to suppress crowds.

Thus, an LED light and sound ball for emergency responders solving the aforementioned problems is desired.

SUMMARY

The LED light and ball for emergency responders is activated upon contact after being fired from a launcher to illuminate an area of interest, such as a potential crime scene. The ball includes a clear polymeric, spherical, slightly flexible outer casing, and a clear rectangular inner casing having a circuit board mounted therein. A plurality of rig rods extend through the inner casing and include curved heads that are in close proximity to the inner surface of the spherical outer casing. Upon impact, the outer casing flexes and pushes against one of the curved heads and pushes its associated rig rod inward, thereby closing a contact that triggers a control circuit to connect a positive terminal of an internal battery (or batteries) to a plurality of light emitting diodes (LEDs) and a sound generator. The LEDs can, for example, provide 900 lumens per light or more, equaling 2700 lumens or more in total with three LEDs. Once switched on, the control circuit maintains the LEDs lit and completely fills the immediate area with light, while the sound generator is maintained on as well. The light may be provided as a solid ball of light or separate beams of light, and can either be illuminated continuously or in a strobe-like fashion. The sound generator includes a microprocessor, a power amplifier and a speaker or other sound transducer capable of generating, for example, up to 110 to 129 dB of unique siren tones. The siren, like the lights, activates on contact, unless switched off beforehand by the responder. The siren from the sound generator is a distinctive low sound, similar to a pulsing fog horn, so that it is not confused with a fire or car alarm.

While the LED light and sound ball may be thrown, for greater range the LED light and sound ball may be fired from a conventional 40 mm launcher that has a cylinder loaded with compressed air or carbon dioxide to launch other emergency response projectiles (such as bean bags, etc.). The outer casing may be in two hemispherical pieces that are fused together to house the remaining components therein. In a further embodiment, the LED and sound light ball is in the form of a two-piece elongated cylinder with rounded ends. A first front piece has a larger diameter that the second rear piece and slides over the second piece upon impact, thereby activating the above-described rig rods. The various embodiments of the LED light and sound ball may be rechargeable from a power outlet or solar panel.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
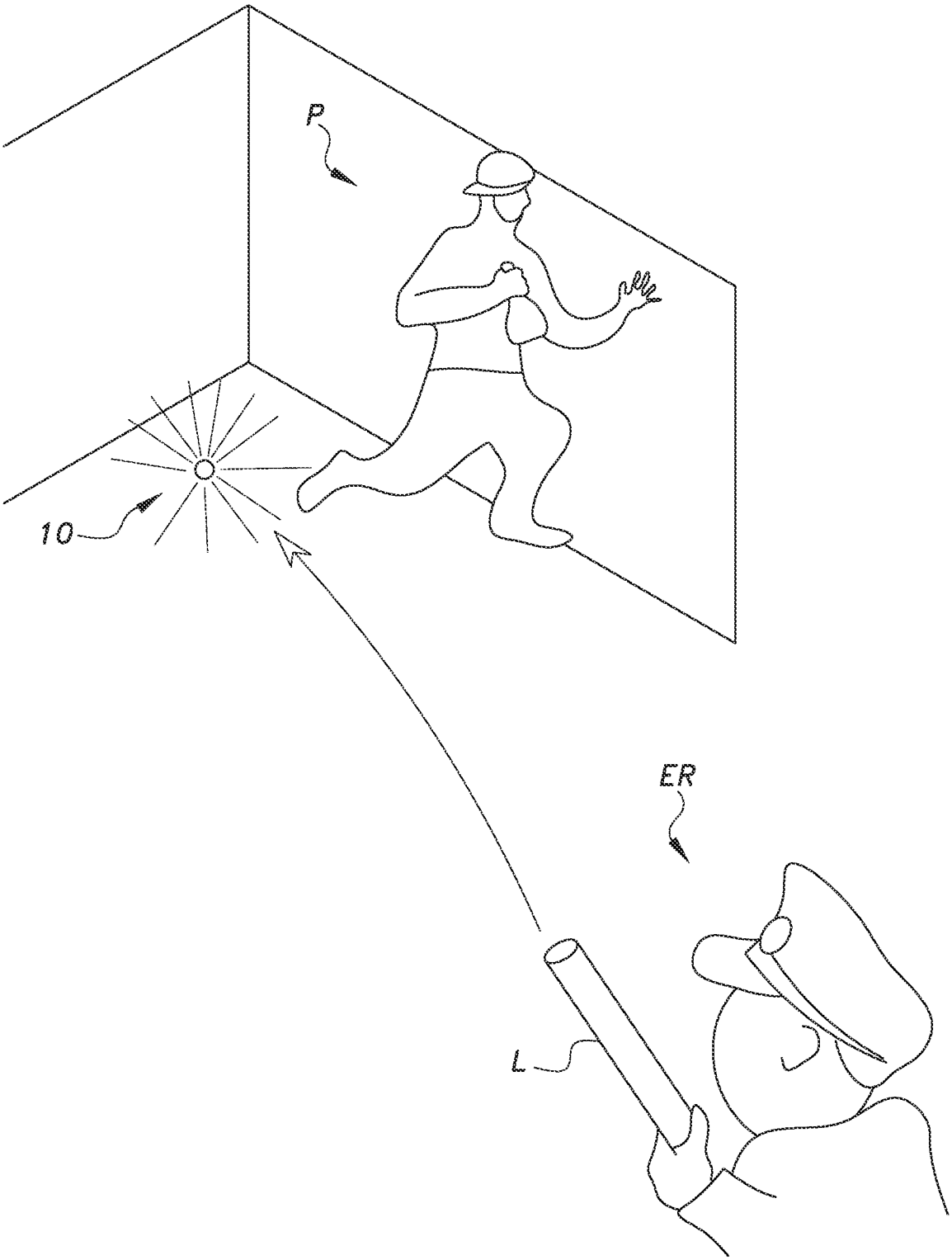
FIG. 1 is an environmental perspective view of an LED light and sound ball for emergency responders, shown being launched by an emergency responder toward an area of interest.
Figure 2:
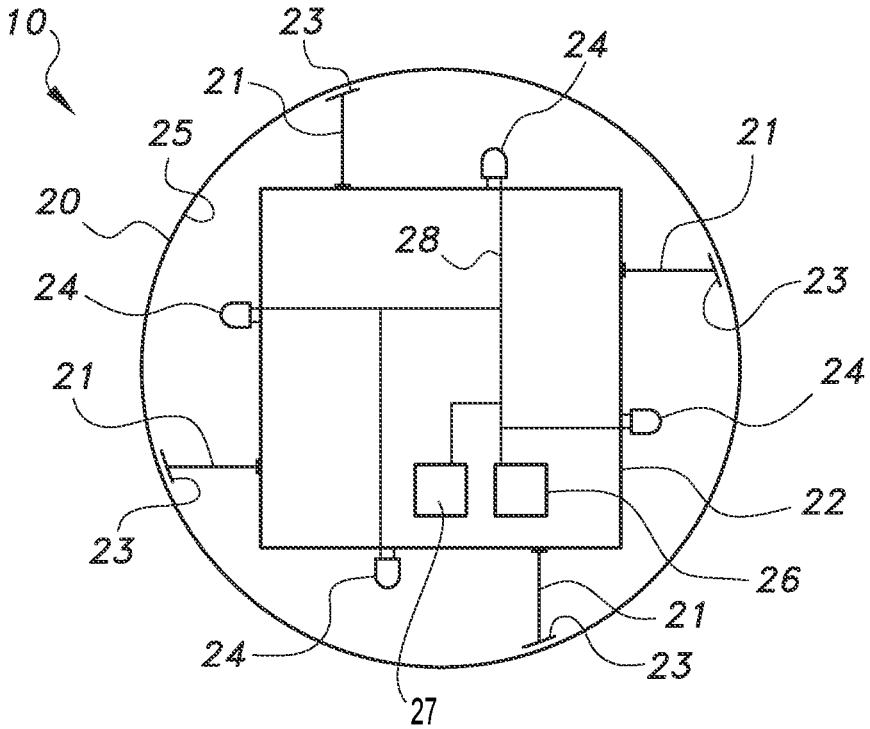
FIG. 2 is a top view of the LED light and sound ball of FIG. 1.
Figure 3:
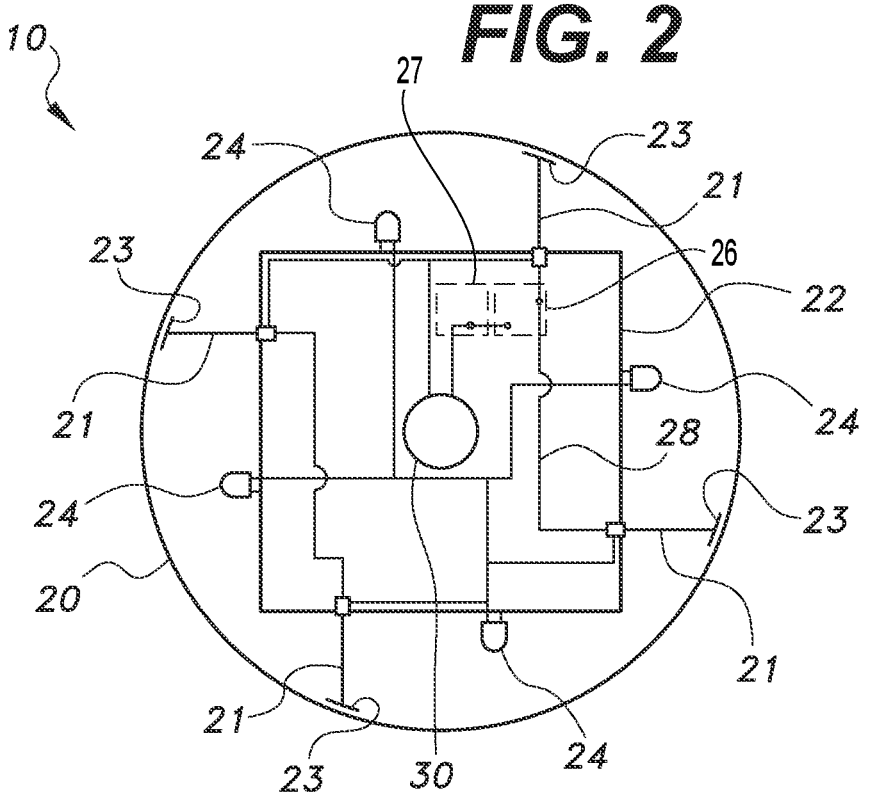
FIG. 3 is a bottom view of the LED light and sound ball of FIG. 1.
Figure 4:
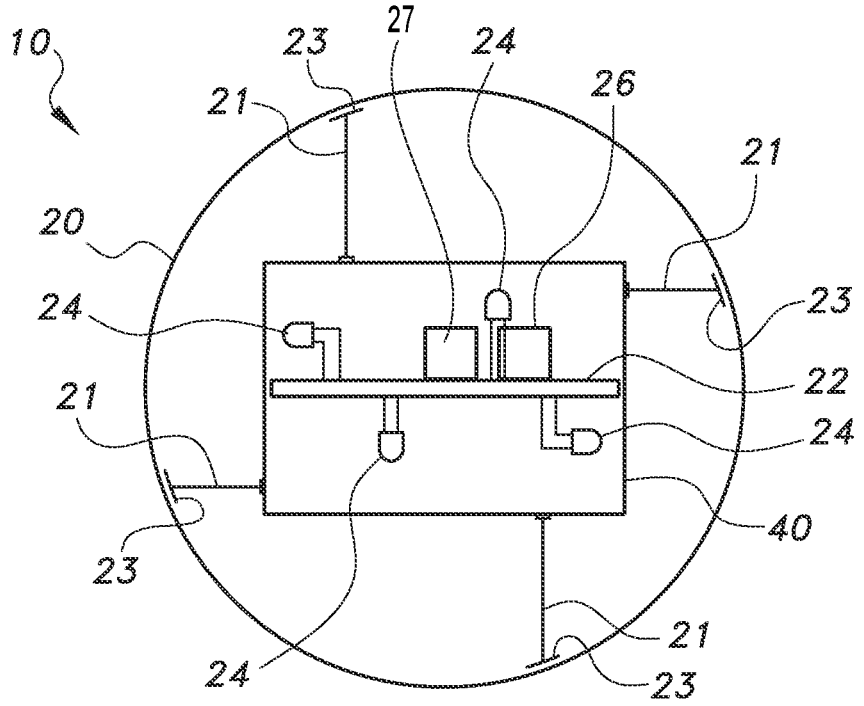
FIG. 4 is a side view of the LED light and sound ball of FIG. 1

The LED light and sound ball for emergency responders, designated generally as 10 in the drawings, is shown in FIG. 1, having been activated upon contact after being launched by an emergency responder ER from a launcher L to illuminate an area of interest P, such as a potential crime scene. While the LED light and sound ball may be thrown, for greater range the LED light and sound ball is fired from a launcher that has a cylinder loaded with a compressed gas, such as compressed air or carbon dioxide, to launch emergency response projectiles. The details of the LED light and sound ball 10 are best seen in FIGS. 2-4. The light ball includes a clear polymeric, spherical, slightly flexible outer casing 20, similar to hollow, transparent polymer toy balls. As with the toy balls, the outer casing 20 is resilient and yields upon impact, but returns to its spherical shape thereafter. The outer casing 20 may be in two hemispherical pieces that are fused together to house the remaining components therein. A rectangular, clear inner casing 40 (FIG. 4) is mounted within the outer casing 20, and a printed circuit board 22 is mounted within the inner casing 40. The circuit board 22 includes a plurality of conductive traces 28 (shown in FIGS. 2 and 3) for making the electrical connections, as described below with respect to the block diagram of FIG. 5. It should be noted that the traces 28 shown in FIGS. 2-3 are for illustrative purposes only and are not intended to represent the actual traces on the circuit board 22. A plurality of rig rods 21 extend through the inner casing 40 and include curved heads 23 that are in close proximity to the inner surface 25 of the spherical outer casing 20. Upon impact with a surface, the outer casing 20 flexes and pushes against one of the curved heads 23 (depending on the area of impact on the spherical outer casing 20) and pushes its associated rig rod 21 inward, thereby closing an electrical contact (not shown). The light ball 10 also includes a plurality of high-power LEDs 24 mounted on or near the circuit board 22, capable of producing 2700 lumens or more in total, one or more batteries 30 for powering the light ball, a sound generator 27 and an integrated circuit or latch 26. The rig rods 21 are, in essence, momentary switches connected in parallel and having elongated contact pins that are activated by contact of the ball 10 with an object applying sufficient pressure to the head of at least one contact pin to momentarily apply power to the LEDs 24. The rig rods are spaced radially so that contact at any angle is sufficient. Once turned on, the latch 26 keeps the LEDs 24 and sound generator 27 turned on until power is dissipated or disconnected.

Figure 5:
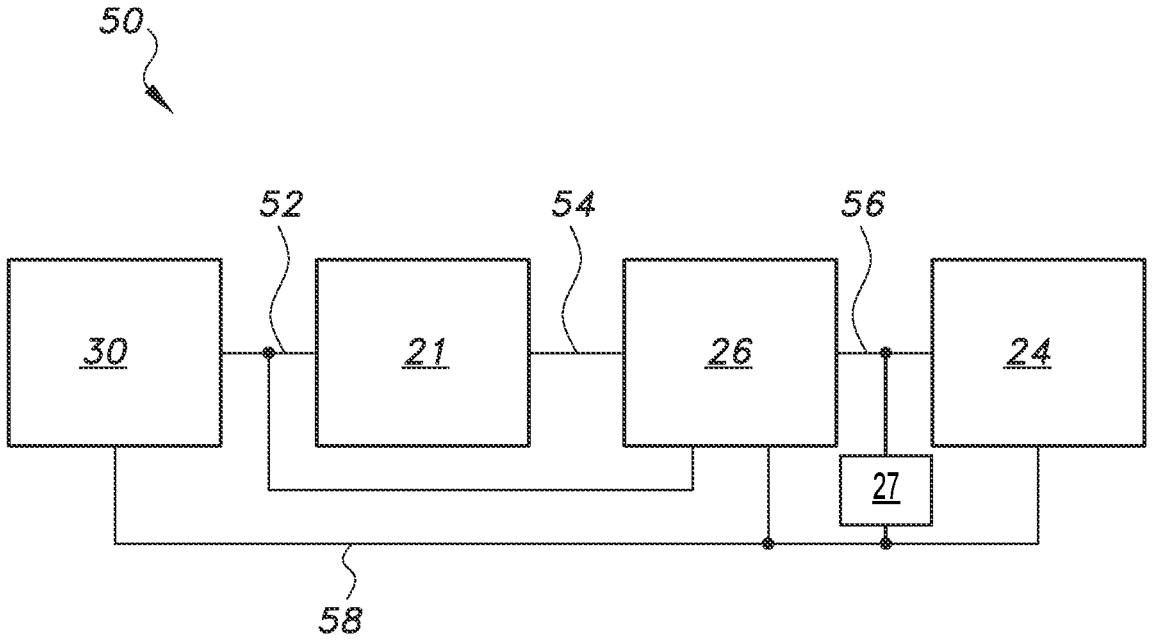
FIG. 5 is a block diagram of an electrical circuit of the LED light and sound ball of FIG. 1.

FIG. 5 shows a block diagram 50 of the electrical circuit of the LED light ball for emergency responders 10. The positive electrode of the battery 30 is connected to one of the contacts of each of the rig rods 21 and to a first terminal of the circuit or latch 26 by first wire and/or trace 52. The other contact of each of the rig rods 21 is connected to a second terminal of the circuit or latch 26 by a second wire and/or trace 54. A third terminal of the integrated circuit or latch 26 is connected to the positive lead of all of the LEDs 24 and the positive lead of the sound generator 27 by a third wire and/or trace 56. The negative electrode of the battery 30 is connected to a fourth terminal of the circuit or latch 26 and to the negative lead of all of the LEDs 24 and the negative lead of the sound generator 27 by a fourth wire and/or trace 58. The contacts for the rig rods 21 are wired in parallel, such that a single activated rig rod triggers the integrated circuit or latch 26 to connect the positive terminal of the internal battery (or batteries) to all of the LEDs 24 and the sound generator 27. The LEDs, for example, can provide 900 lumens per light or more equaling 2700 lumens or more in total with three LEDs. The circuit 26 may be a simple latching micro-relay that maintains the LEDs lit and the sound generator 27 turned on, once triggered by one or more of the rig rods 21. In other embodiments, the circuit 26 is a programmable integrated circuit that can provide strobe-like, light pattern flashing or other lighting and sound functions. Furthermore, the rig rods 21 are only one way of triggering the circuit 26, and other devices or circuits for triggering the circuit 26, such as an accelerometer, are contemplated.

Figure 6:
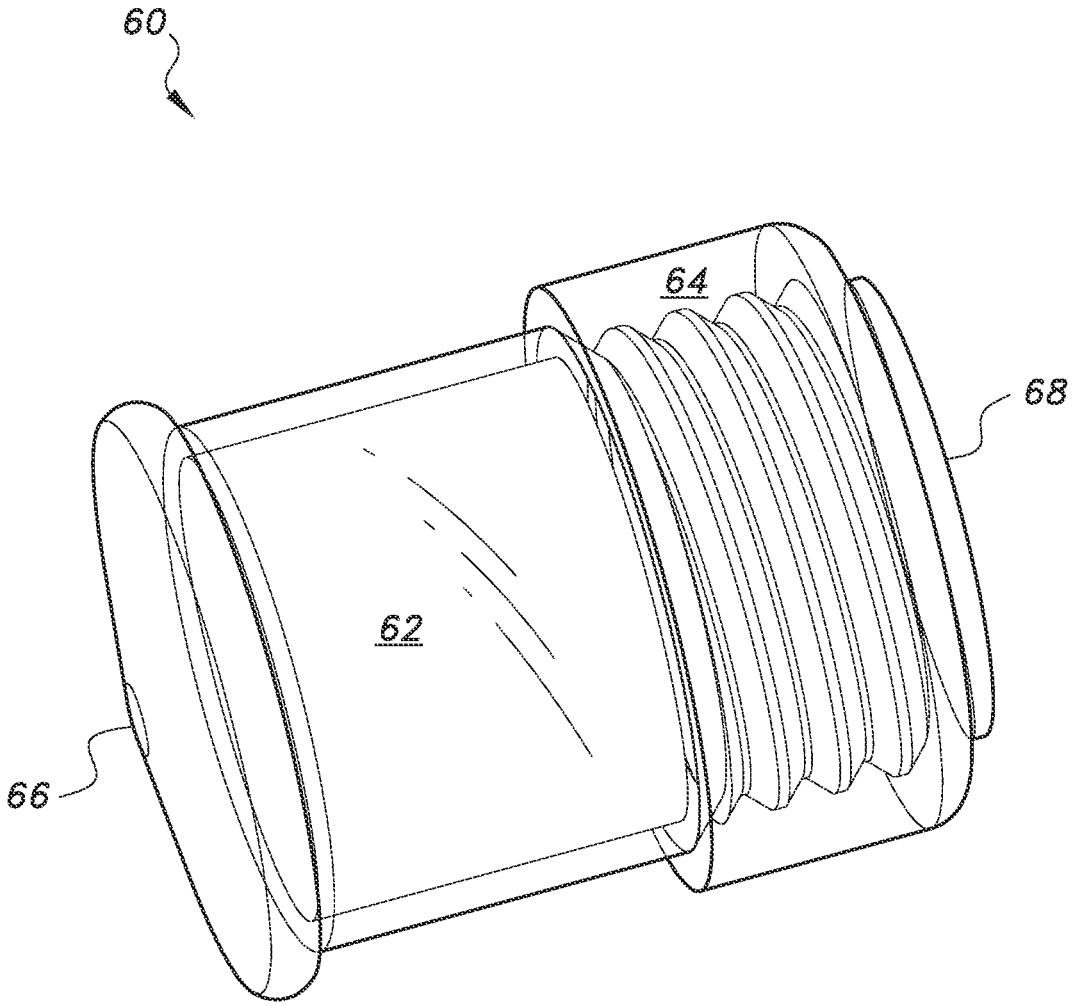
FIG. 6 is a perspective view of an alternative embodiment of an LED light and sound ball for emergency responders.

A further embodiment of the LED light and sound ball (or projectile) 60 is shown in FIG. 6. The LED light and sound projectile 60 has an outer casing in the form of a two-piece elongated cylinder with rounded ends. The LED light and sound projectile 60 includes all the components as described with respect to the first embodiment of FIGS. 1-5. The first, front piece 64 is in the form of a short cylinder with a rounded closed end 68 and an open second end. The second, rear piece is in the form of an elongate cylinder 62 with a rounded closed end 66 opposite to the rounded closed end 68 of the first, front piece 64 and an open second end. The first front piece 64 has a larger diameter than the second rear piece 62 and slides over the second piece 62, the open second end of the second piece 62 being frictionally inserted into the open end of the first front piece 64. The previously described rig rods 21 are disposed within the projectile 60 such that their heads 23 are in close proximity to an inner surface of the rounded closed end 68. Upon impact with a surface, the front piece 64 is driven backwards against the rig rods 21, thereby activating the LEDs 24 and sound generator 27, as described above with respect to the embodiment of FIGS. 1-5. Unlike the LED light and sound ball 10, the LED light and sound projectile 60 is less likely to continue rolling past the area of interest.

It is to be understood that the LED light and sound ball for emergency responders is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. An LED light ball for emergency responders, comprising: a transparent outer casing;

a circuit board mounted within the transparent outer casing; at least one battery having a negative electrode and a positive electrode; a control circuit mounted on the circuit board and electrically connected to the negative electrode and the positive electrode of the at least one battery; at least one LED having a negative terminal electrically connected to the negative electrode of the at least one battery and a positive terminal electrically connected to the control circuit; and at least one momentary switch connected between the control circuit and the positive electrode of the at least one battery, the at least one momentary switch having a contact pin oriented inside the outer casing so that contact of the outer casing with an object exerts pressure on the contact pin closet be momentary switch and apply power from the battery to the control circuit to turn on the least one LED, the control circuit including a latch circuit for keeping the at least one LED turned on until power is exhausted or disconnected;

wherein the transparent outer casing is a two-piece elongated cylinder including: a first, front piece, the first, front piece being a short cylinder having a first diameter, a rounded closed end having an inner surface, and an open second end; and a second, rear piece, the second, rear piece being an elongate cylinder having a second diameter, a rounded closed end opposite to the rounded closed end of the first, front piece, and an open second end, the first diameter being larger than the second diameter such that the first, front piece slides over the second rear piece, the contact pin of the at least one momentary switch being disposed within the casing such that the contact pin is in close proximity to the inner surface of the rounded closed end of the front piece, such that contact of the first, front piece with an object drives the first front piece backwards relative to the second, rear, piece, thereby exerting pressure on the contact pin to close the at least one momentary switch.

2. The LED light ball for emergency responders according to claim 1, wherein the transparent outer casing is polymeric.

3. The LED light ball for emergency responders according to claim 2, wherein the transparent outer casing is spherical.

4. The LED light ball for emergency responders according to claim 3, wherein the at least one momentary switch comprises a plurality of momentary switches, each of the momentary switches having a contact pin, and the contact pins being spaced radially around the spherical, transparent outer casing.

5. The LED light ball for emergency responders according to claim 4, further comprising an inner casing mounted within the outer casing, and wherein:

the printed circuit board is mounted within the inner casing; and the contact pins extend through the inner casing.

6. The LED light ball for emergency responders according to claim 3, wherein the at least one LED comprises a plurality of LEDs.

7. The LED light ball for emergency responders according to claim 6, wherein the plurality of LEDs produces at least 2700 lumens.

8. The LED light ball for emergency responders according to claim 1, wherein the at least one LED comprises a plurality of LEDs.

9. The LED light ball for emergency responders according to claim 8, wherein the plurality of LEDs produces at least 2700 lumens.

10. The LED light ball for emergency responders according to claim 9, further comprising an inner casing mounted within the outer casing, and wherein:

the printed circuit board is mounted within the inner casing: and the contact pin extends through the inner casing.

11. The LED light ball for emergency responders according to claim 1, further comprising a sound generator, the latch circuit keeping the sound generator on until power is exhausted or disconnected.

12. A method illuminating an area of interest, comprising the steps of: providing an LED light ball, the LED light ball including: a transparent outer casing; at least one LED; at least one momentary switch, the at least momentary switch being closed by contact of the outer casing with an object; and means for illuminating the at least one LED when the momentary switch is closed; and directing the LED light ball toward the area of interest; wherein the transparent outer casing is a two-piece elongated cylinder including: a first, front piece, the first, front piece being a short cylinder having a first diameter, a rounded closed end having an inner surface, and an open second end; and a second, rear piece, the second, rear piece being an elongate cylinder having a second diameter, a rounded closed end opposite to the rounded closed end of the first, front piece, and an open second end, the first diameter being larger than the second diameter such that the first, front piece slides over the second rear piece, the contact pin of the at least one momentary switch being disposed within the casing such that the contact pin is in close proximity to the inner surface of the rounded closed end of the front piece, such that contact of the first, front piece with an object drives the first front piece backwards relative to the second, rear, piece, thereby exerting pressure on the contact pin to close the at least one momentary switch.

13. The method of illuminating an area of interest according to claim 12, wherein the step of directing the LED light ball toward the area of interest comprises throwing the LED light ball by hand.

14. The method of illuminating an area of interest according to claim 12, wherein the step of directing the LED light ball toward the area of interest comprises launching the LED light ball using a compressed gas launcher.

15. The method of illuminating an area of interest according to claim 12, wherein the LED light ball further comprises a sound generator and means for turning on the sound generator when the momentary switch is closed.

16. An LED light ball for emergency responders, comprising: a transparent outer casing; an inner casing mounted within the outer casing; a circuit board mounted within the inner casing; at least one battery having a negative electrode and a positive electrode; a control circuit mounted on the circuit board and electrically connected to the negative electrode and the positive electrode of the at least one battery; at least one LED having a negative terminal electrically connected to the negative electrode of the at least one battery and a positive terminal electrically connected to the control circuit; and at least one momentary switch connected between the control circuit and the positive electrode of the at least one battery, the at least one momentary switch having a contact pin oriented inside the outer casing so that contact of the outer casing with an object exerts pressure on the contact pin closet be momentary switch and apply power from the battery to the control circuit to turn on the least one LED, the control circuit including a latch circuit for keeping the at least one LED turned on until power is exhausted or disconnected; wherein the transparent outer casing is a two-piece elongated cylinder including: a first, front piece, the first, front piece being a short cylinder having a first diameter, a rounded closed end having an inner surface, and open second end; and a second, rear piece the second, rear piece being an elongate cylinder having a second diameter, a rounded closed end opposite to the rounded closed end of the first, front piece, and an open second end, the first diameter being larger than the second diameter such that the first, front piece slides over the second rear piece, the contact pin of the at least one momentary switch being disposed within the outer casing such that the contact pin is in close proximity to the inner surface of the rounded closed end of the front piece such that contact of the first, front piece with an object drives the first, front piece backwards relative to the second, rear piece, thereby exerting pressure on the contact pin to close the at least one momentary switch, the at least one LED comprising a plurality of LEDs producing at least 2700 lumens.

17. The LED light ball for emergency responders according to claim 16, wherein:

the transparent outer casing is polymeric and spherical;

the at least one momentary switch comprises a plurality of the momentary switches, each of the momentary switches having a contact pin, the contact pins being spaced radially around the spherical, transparent outer casing;

the at least one LED comprises a plurality of LEDs; and the plurality of LEDs produces at least 2700 lumens.

18. The LED light ball for emergency responders according to claim 16, further comprising a sound generator, the latch circuit keeping the sound generator on until power is exhausted or disconnected.

* * * * *